US005857954A

United States Patent [19]

Achelpohl et al.

[11] Patent Number: 5,857,954

[45] Date of Patent: Jan. 12, 1999

[54] APPARATUS FOR MANUFACTURING CROSS BOTTOM SACKS

[75] Inventors: Fritz Achelpohl, Lienen; Richard Feldkamper; Andreas Kampschulte, both of Lengerich; Uwe Köhn, Osnabrück, all of Germany

[73] Assignee: Windmöller & Hölscher, Lengerich/Westf., Germany

[21] Appl. No.: 590,276

[22] Filed: Jan. 23, 1996

[30] Foreign Application Priority Data

Jan. 25, 1995 [DE] Germany ..... 195 02 251.3

[51] Int. Cl.[6] ..... B31B 1/60

[52] U.S. Cl. ..... 493/255; 493/245; 493/253; 493/256; 493/258

[58] Field of Search ..... 493/79, 80, 167, 493/169, 174, 177, 178, 180–183, 209, 212, 215, 219, 218, 228–231, 240, 242, 243, 245, 246, 251, 253, 254, 255, 256, 258, 259, 309, 313, 315, 355, 356, 405, 936, 210, 213

[56] References Cited

U.S. PATENT DOCUMENTS

| | | | |
|---|---|---|---|
| 863,731 | 8/1907 | Lorenz | 493/256 |
| 1,165,765 | 12/1915 | Duvall . | |
| 2,224,656 | 12/1940 | Robinson | 493/256 |
| 3,927,606 | 12/1975 | Brockmuller | 493/218 |
| 4,285,685 | 8/1981 | Achelpohl | 493/406 |
| 4,371,367 | 2/1983 | Achelpohl | 493/256 |
| 4,493,686 | 1/1985 | Eckelt | 493/256 |
| 4,610,651 | 9/1986 | Jacobson | 493/313 |
| 4,626,236 | 12/1986 | Maurer | 493/313 |
| 4,917,659 | 4/1990 | Mohaupt | 493/181 |
| 5,102,384 | 4/1992 | Ross | 493/243 |
| 5,106,359 | 4/1992 | Lott | 493/181 |
| 5,120,295 | 6/1992 | Mosse | 493/191 |
| 5,135,464 | 8/1992 | Buchanan | 493/231 |
| 5,149,315 | 9/1992 | Muhs | 493/253 |
| 5,273,513 | 12/1993 | Wallin | 493/167 |

*Primary Examiner*—Joseph J. Hail, III
*Assistant Examiner*—Christopher W. Day
*Attorney, Agent, or Firm*—Evenson, McKeown, Edwards & Lenahan, PLLC

[57] ABSTRACT

An apparatus for manufacturing cross bottom sacks from laid-flat tubular sections consists of a frame having:- a table, means for holding the tubular section thereon in a processing station where the ends of the tubular section become opened out into a bottom square or rectangle, a suction gap arranged in the table in the zone of one of the ends of the tubular section, and suction means mounted in the frame above the suction gap and which is able to be raised and lowered for opening one end of the tubular section. Above the plane of the tubular section situated in the processing station, a slide can be extended and retracted over the table in the direction of the median line of the tubular section, the median line of the slide defining with the median line of the tubular section a plane perpendicular to the plane of the tubular section. The width of the slide is less than the interspacing of the hypotenuses of the two opened-out corner folds from each other. The two shaping plungers are designed in a mirror image arrangement and are mounted for being raised and lowered onto the table; their shape corresponds to the shape of the corner folds.

7 Claims, 3 Drawing Sheets

APPARATUS FOR MANUFACTURING CROSS BOTTOM SACKS

FIELD OF THE INVENTION

The invention concerns an apparatus for manufacturing cross bottom sacks or bags from laid-flat tubular sections.

PRIOR ART

The bottoms of so-called cross bottom sacks or bags are usually formed in bottom-laying machines from laid-flat tubular sections of paper or a film of a plastic material which continuously pass through the bottom-laying machines in a transverse disposition. Because of the existence of various processing stations at which a particular bottom-laying machine has means for:- opening out the ends of the continuously conveyed tubular sections into the bottom squares forming the open bottoms, and for fixing and closing the bottoms with the insertion of valve leaves or tubes, and for attaching bottom cover sheets onto the closed bottoms, the known bottom-laying machines usually having a high output potential are complicated and expensive. There is therefore the need for a lower performance machine whereby cross bottom sacks can be produced which is cheaper and involves only a lower investment expenditure, so that it lies also within the reach of smaller concerns and so that the capacity of the machine can be exploited to the fullest extent.

OBJECT OF THE INVENTION

It is therefore the object of the invention to create an apparatus of the kind indicated at the outset which has a simple design and can be produced at low costs.

SUMMARY OF THE INVENTION

In accordance with the invention, there is provided an apparatus for manufacturing cross bottom sacks from laid-flat tubular sections, comprising:-

- a frame with a plate or table with means for holding the tubular section thereon in a processing station where the ends of the tubular section are opened out into a bottom square or rectangle;
- a suction opening arranged in the table in the vicinity of one of the ends of the tubular section;
- suction means mounted in the frame above the suction opening and able to be raised and lowered for opening one end of the tubular section;
- a slide that can be extended and retracted over the table, above the plane of the tubular section situated in the processing station and in the direction of its median line, the median line of which slide defines with the median line of the tubular section a plane disposed at right angles to the plane of the tubular section, and whose width is less than the interspacing of the hypotenuses of the two opened-out corner folds; and
- two symmetrically arranged plungers which are mounted in a frame that can be raised and lowered onto the table, and whose shape corresponds to the shape of the corner folds.

In contrast to the known bottom-laying machines with a high output with a continuous (uninterrupted) conveying action for the tubular sections to and through the various processing stations, the apparatus in accordance with the invention may operate on a single sack or bag bottom in an indexing sequence of steps. This means that the tubular sections, of paper but preferably of a film of plastic material, are conveyed or indexed from one processing station into the next and introduced to the apparatus at the various stations in a timed sequence to be processed, while stationary, at that processing station. In the processing station, situated on the plate or table, the first step is that of forming the cross bottom and is undertaken at at least one end of the stationary tubular section. This first step involves opening out one end of the tubular section into a bottom square. To allow this work to be undertaken on the tubular section, there are means for holding the tubular section in this processing station, such means consisting, for example, of the holding means of a conveyor conveying the tubular sections intermittently from one processing station to another.

It is, of course, also possible to dispense with these holding means and/or an indexing (intermittently conveying) conveyor, and instead to insert the individual tubular sections into the processing station by hand.

At this processing station the table has, in the vicinity of one end of the tubular section, a suction gap or suction bores through which low pressure can be applied to suck the bottom layer of the end of the tubular section onto the table and thereby to hold it fast. Above the suction gap or suction bores, suction means are mounted in the frame and can be raised and lowered to suck up the top layer of the end of the tubular section and slightly open the tubular section by an appropriate lifting of its top layer. After this preliminary opening of one end of the tubular section fixed on the table in the processing station, a slide moves between the two layers of the tubular section closely above the plane of the otherwise laid flat tubular section and folds the raised upper layer of the tubular section through 180° onto the tubular section, so that the bottom square or rectangle is thereby opened out. For shaping the bottom corner folds formed by this opening-out, shaping plungers, whose shape corresponds to the corner folds, are lowered onto them. When the bottom has been opened out in the processing station in the way described, the sack with the opened-out bottom is brought or conveyed into downstream processing stations where valve leaves or valve portions are inserted in the usual way, the bottoms are formed by the folding-in of the bottom side folds overlapping one another, and bottom cover sheets are bonded onto the closed bottoms. The appropriate processing in such downstream processing stations may be effected in a time sequence or yet by a subsequent continuous conveyance of the bag or sack workpieces.

When the bottom has been opened-out in the processing station in the way described, clamps or plates may act thereon to keep the opened-out bottom square in position after the slide and the shaping plungers have been removed.

In a further development of the invention, two plungers may be arranged in the frame so as to be extended and retracted, and they can move between the opened edges of the tubular section and press against the table the zones of the bottom side of the tubular section adjoining the later corner folds of the opened-out bottom. The interspacing of these plungers from one another is greater than the width of the slide. These plungers are provided in pairs and keep the ends of the tubular section in position while the bottom square is opened out, so that a proper and clear cut formation of the bottom corner folds is ensured.

Expediently the slide which opens out the bottom is pivotably mounted in the frame so that, in opening out the bottom, it can move away beyond the median line of the bottom at such a distance that it cannot enter between the two layers of the tubular section in the vicinity of the median line of the sack or bag bottom. When the slide has passed beyond the zone of the median line of the bottom, it can be lowered flat onto the tubular section so that the zone of the opened-out bottom which has been folded back onto the tubular section is pressed against the tubular section. Instead of a pivotably mounted slide, there may be used a slide which can be raised and lowered onto the table.

The width of the slide is expediently adapted to the respective size of the bottom.

In a further development of the invention provision is made for the slide and the shaping plunger, lying ahead of the slide in the removal direction of the tubular section, to be arranged at staggered heights, in such a way that the tubular section can be carried forward with its opened-out bottom, without impediment.

Expediently a scoring station is arranged on the table, offset ahead of the processing station, wherein a knife can be lowered and raised in guides of the frame to mark the median line of the bottom. This knife forms a scored line or incipient break which subsequently promotes the clean folding round the median line of the bottom in the processing station.

Instead of the marking of the median line of the bottom by a knife, it is also possible for a ruler in the processing station to be lowered or applied onto the tubular section with its front edge lying on the median line of the sack or bag bottom. This ruler then serves for the clean turning over of one half of the sack or bag bottom and is removed after the bottom has been opened out.

The apparatus in accordance with the invention preferably serves for forming bottoms on tubular sections made of a plastic material. The tubular sections of a plastic material may also, for example, be coated fabric strips.

If the bottoms are formed onto tubular sections of a plastic material, the knife is expediently heated to form in a better way the score line defining the median line of the bottom.

In the processing of tubular sections of plastic material, the shaping plungers are also expediently heated to obtain a better preliminary fixing of the corner folds pressed flat by the plungers.

Since the tubular sections are usually provided with cross bottoms at both ends to form containers which can be likened to double-ended bags or sacks (one end of which may be provided with a filling valve for products such as cement, fertilizer or animal feedstuff), the devices of the processing station, and if applicable of the scoring station, may be provided in a dual configuration in a mirror-image arrangement with respect to the transverse median line of the tubular section.

BRIEF DESCRIPTION OF THE DRAWINGS

An example of an embodiment of the invention will be explained in greater detail below with reference to the accompanying drawings, in which.

DETAILED DESCRIPTION OF THE PREFERRED EMBODIMENT

Figure 1:
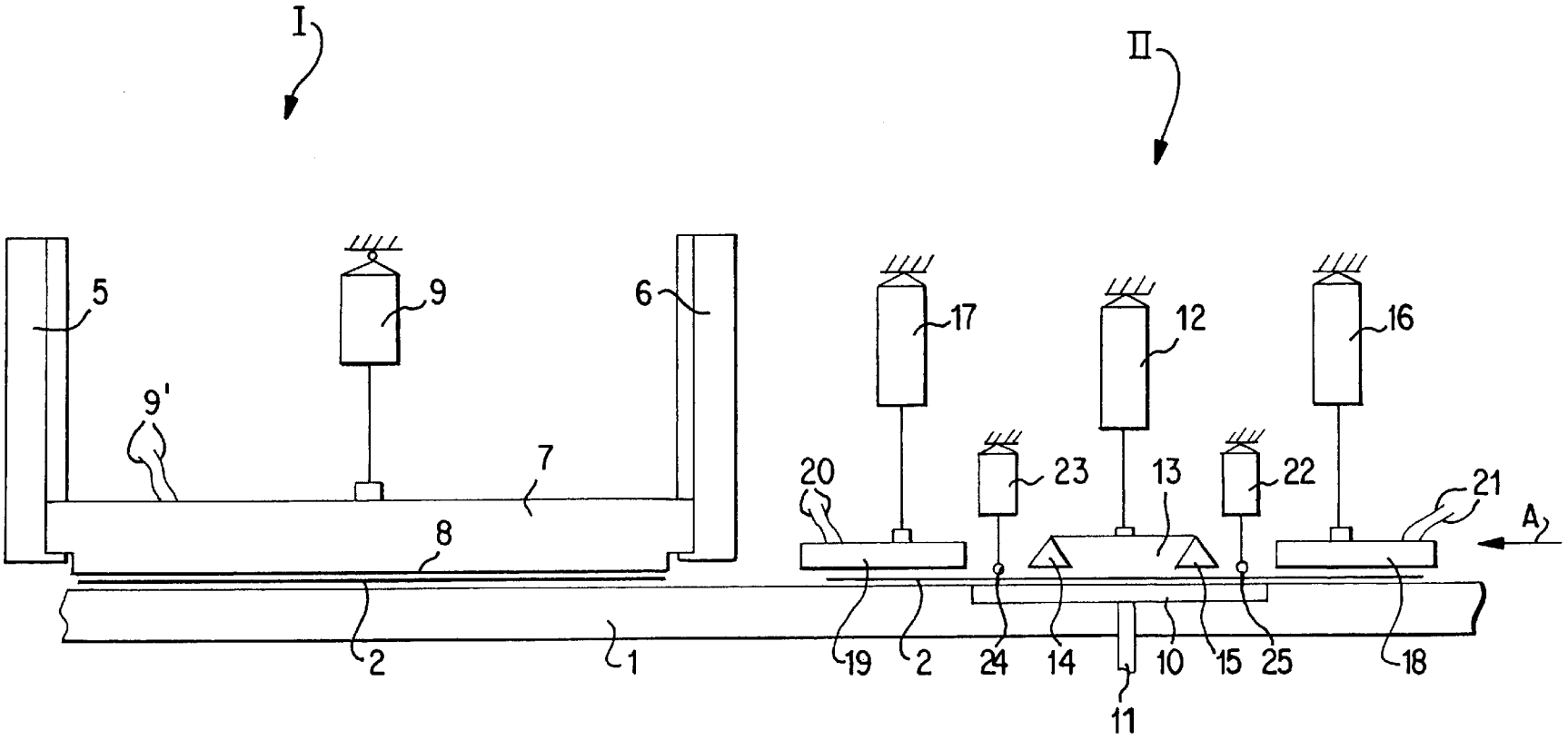
FIG. 1 is a side view, in a schematic representation, of the apparatus in accordance with the invention.

In a frame, not shown, of the apparatus there is mounted a table plate 1 which forms the processing base for the tubular sections 2. On the table plate 1, there are carried out two processes on the tubular sections of a film of plastic material or of coated plastic fabric strips. These are, on the one hand, a marking of the subsequent median line 3 of the bottom in the scoring station I and, on the other hand, the opening-out of the end of the tubular section in the processing station II.

The scoring station I consists of two lateral guides 5, 6 which are fixed to the frame and wherein a knife 7 with a lower straight sharp edge 8 is carried for displacement parallel to itself. For raising and lowering the knife 7 onto the table plate 1, a piston-cylinder unit (ram) 9 is provided, whose cylinder is articulated to the frame and whose piston rod is articulated to the knife 7. The knife 7 is electrically heatable, which is indicated by the electric cables 9'. When the subsequent median line 3 of the bottom has been marked, the tubular section is carried forward into the processing station II in one further sequence or is brought there in another way.

Figure 2:
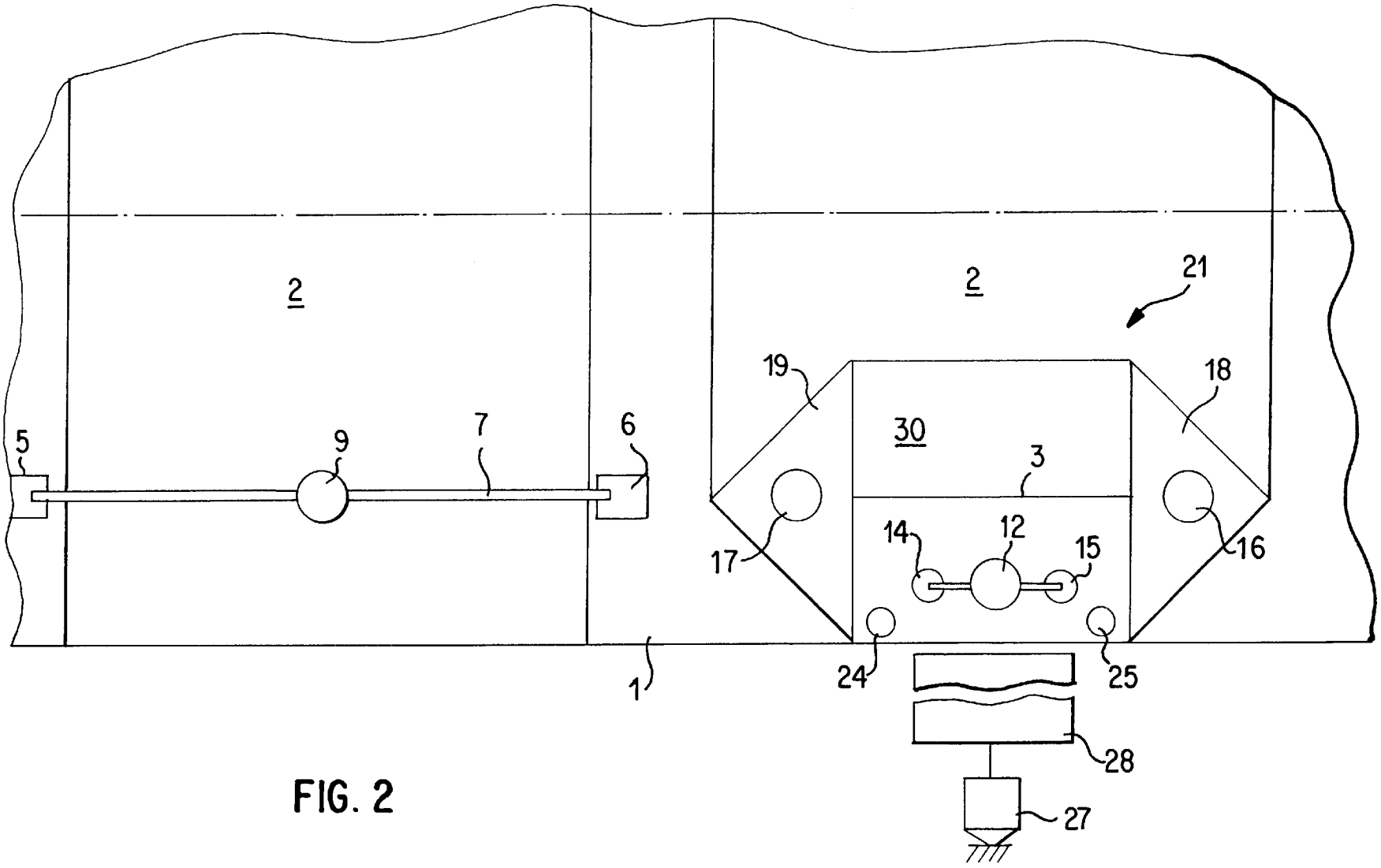
FIG. 2 is a top plan view of the apparatus of FIG. 1.
Figure 4:
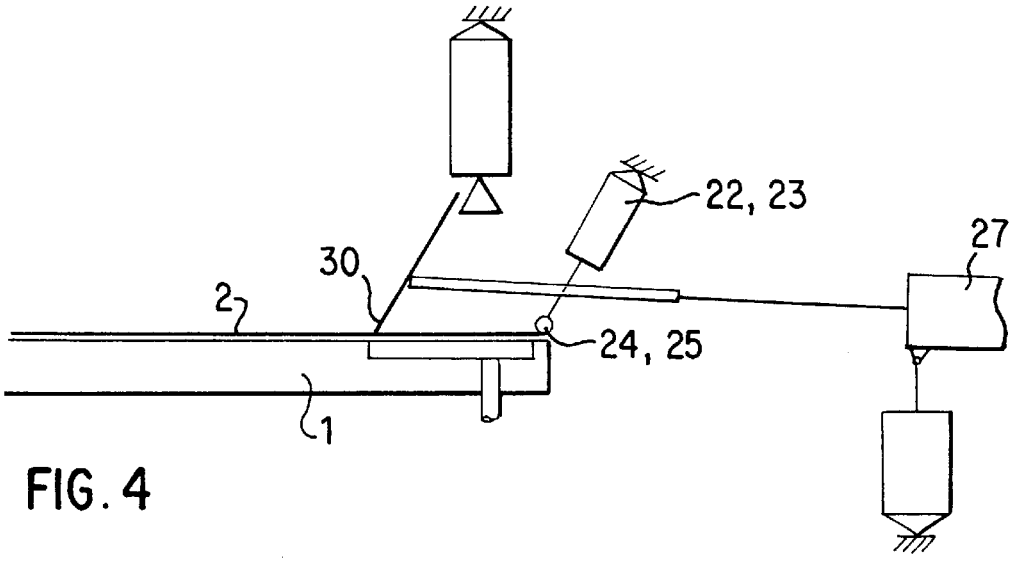
Figure 5:
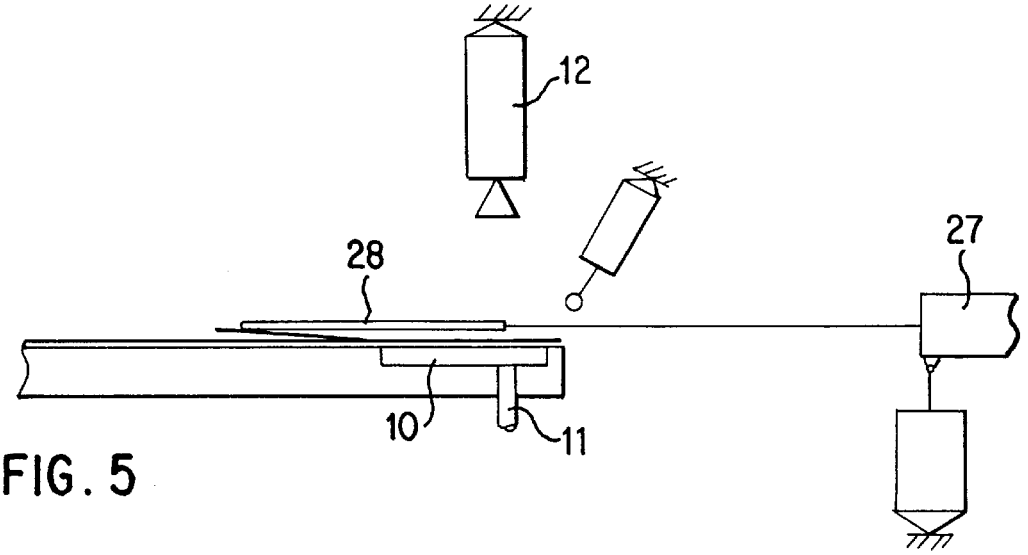

In the processing station II, the table plate 1 is provided in the front median end zone of the tubular section 2 with a suction gap 10 which is provided with low pressure via a line 11. A fluid pressure operated piston-cylinder unit (ram) 12 is mounted above the table plate 1 in the frame, with its piston rod carrying two suction means 14, 15 mounted on a transverse support 13 whereby the suction means can be raised and lowered by means of the fluid pressure-operated rams 12. Moreover, two further fluid pressure-operated rams 16, 17 are arranged in the frame at the side of the ram 12, with their piston rods carrying shaping plungers 18, 19 whose shape corresponds to the shape of the corner folds of the opened-out bottoms 21 as is shown in FIG. 2. The shaping plungers 18, 19 can also be heated, as is indicated by the electric cables 20, 21. In the frame there are also mounted fluid pressure-operated rams 22, 23 whose piston rods carry rubber plungers 24, 25. The rams 22, 23 are mounted obliquely in the frame, as shown in FIGS. 3 to 5, so that the rubber plungers 24, 25 can already be run in between the layers of the tubular section that are slightly moved away from each other, and press the bottom layer in the zone of the front corners of the subsequent corner folds against the table plate 1, as is shown in FIG. 2.

Finally, a fluid pressure-operated ram 27 is mounted in the frame, with its piston rod carrying a slide 28 that can be extended and retracted over the table 1 between the plungers 24, 25 closely above the plane of the tubular section held on the table plate 1. The ram 27 is connected to a further fluid pressure-operated ram 35 in the way schematically arranged in FIGS. 3 to 5, so as to raise and lower the cylinder of the ram 27 relative to the table plate 1.

Figure 3:
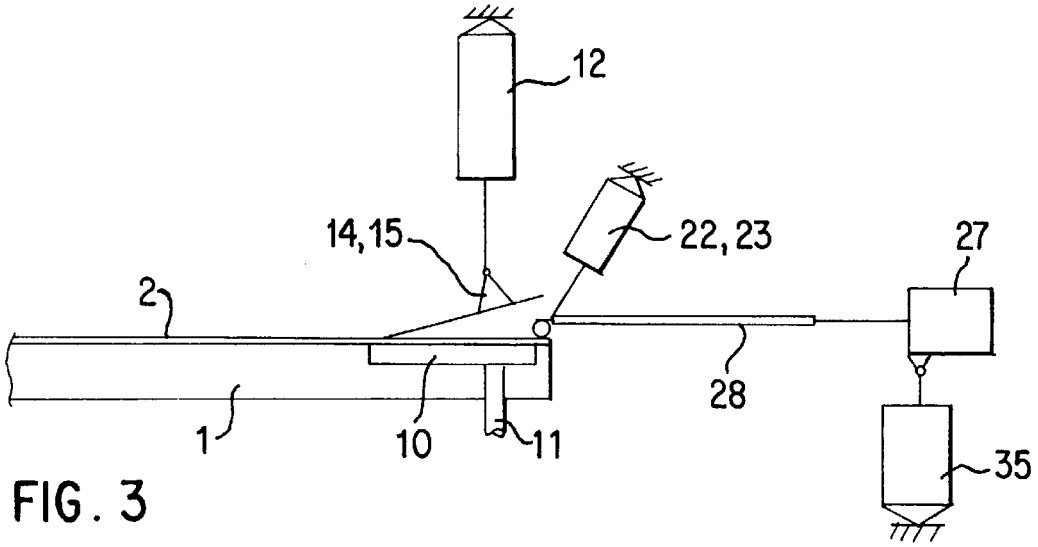
FIGS. 3 to 5 are views of the apparatus, seen in the direction of arrow A in FIG. 1, in different stages during the opening and opening out of one end of the tubular section.

In the processing station shown in FIG. 3, the suction means 14 , 15 have slightly lifted the upper layer of the tubular section 2 so that the plungers 24, 25 can be moved in and press the bottom layer of the tubular section 2 against the table plate 1 to assist the suction means 11.

In this position, the slide 28 can then be inserted between the plungers 24, 25. The slide 28 is extended in a configuration slightly raised above the table plate 1, so that it folds over the upper layer of the tubular section 2 round the median line 3 of the bag bottom, and thereby opens the bottom square or rectangle and stretches it out.

When the slide 28 has reached its extended position, it is lowered to the configuration shown in FIG. 5, so that it presses down the bottom flap 30, folded over through 180° onto the tubular section, against the tubular section 2.

After the bottom has been opened-out in this way, the shaping plungers 18, 19 are lowered, to fix the corner folds and, as it were, to iron them in. When the bottom has been opened-out in the way described, the tubular section is brought to the downstream processing stations with the opened-out rectangular or square bottom fixed in position.

In order to allow the bag bottom to be advanced from its position beneath the slide 28, the slide 28 is then lifted. Simultaneously, at least that shaping plunger 19, which is the one downstream when considered in relation to the direction of travel A of the workpiece through the bag bottom forming station, must be lifted higher than the position of the slide. This staggering of the heights of the slide 28 and shaping plunger 19 allows for the fact that as the bag bottom is conveyed from beneath the slide 28 it will begin to erect and will then have, when in register with the shaping plunger 19, a height which is greater than that which it has on lifting of the slide 28.

We claim:

1. An apparatus for opening out first ends of crosswise and flat laying, continuously conveyed tubular sections made of paper or plastic foil comprising:

a table plate for supporting each of the tubular sections in a processing station at which a first end of each tubular section is opened;

a suction cap arranged in the table plate so as to be located below the first end of each tubular section;

suction means for applying suction mounted above the suction gap;

a unit for raising and lowering the suction means in order to separate upper and lower layers of the first end of each tubular section;

a slide that can be extended and retracted over the table plate, above a plane of the table plate, in the processing station in order to selectively engage the upper layer of the first end of each tubular section above a median line thereof;

a device for lowering the slide when the slide is extended so as to fold over the upper layer and open out the first end of the tubular section; and two symmetrically arranged plungers mounted so that they can be raised from and lowered onto the table plate to fix corner folds produced when the upper layer is folded over.

2. An apparatus according to claim 1, and further comprising two extensible and retractable further plungers arranged to press, against the table plate, zones of the lower layer of the first end of the tubular section, the further plungers being disposed at a distance from each other which is greater than a width of the slide.

3. An apparatus according to claim 1, wherein the slide is pivotably mounted in a frame supporting the table plate.

4. An apparatus according to claim 1, wherein the slide can also be raised from the table plate by said device.

5. An apparatus according to claim 1, and further comprising a scoring station situated on the table plate ahead of the processing station, a knife in said scoring station which marks said median line, and guides in the frame by which the knife can be lowered onto and raised from the table plate.

6. An apparatus according to claim 5, wherein the knife is heatable.

7. An apparatus according to claim 1, wherein the shaping plungers are heatable.

* * * * *